United States Patent [19]

Inger

[11] 4,326,372

[45] Apr. 27, 1982

[54] APPARATUS FOR BRAKING AND POSITIONING A SPINNING OR TWISTING SPINDLE

[75] Inventor: Siegfried Inger, Krefeld, Fed. Rep. of Germany

[73] Assignee: Palitex Project-Company GmbH, Krefeld, Fed. Rep. of Germany

[21] Appl. No.: 190,378

[22] Filed: Sep. 24, 1980

[30] Foreign Application Priority Data

Oct. 2, 1979 [DE] Fed. Rep. of Germany ..... 2939862

[51] Int. Cl.[3] ..... D01H 7/22

[52] U.S. Cl. ..... 57/88

[58] Field of Search ..... 57/78, 88, 89

[56] References Cited

U.S. PATENT DOCUMENTS

| | | | |
|---|---|---|---|
| 3,269,103 | 8/1966 | Franzen | 57/88 |
| 3,466,865 | 9/1969 | Franzen et al. | 57/88 |
| 3,805,504 | 4/1974 | Franzen | 57/88 X |
| 3,805,507 | 4/1974 | Steppuhn | 57/88 X |

*Primary Examiner*—Donald Watkins

[57] ABSTRACT

An apparatus for braking and positioning a spinning or twisting spindle with the spindle rotor in a specified position, having a spindle brake which engages with a rotary part, preferably a wharve, of the spindle, and, separate from said brake, positioning means comprising an additional braking surface which extends over part of the periphery of a rotary part, preferably a wharve, of said spindle and up to which an additional brake member is movable. The apparatus provides a more simply constructed braking and positioning means where it is permissible for the spindle to be stopped within a certain angular range about a prescribed central position. In the illustrated embodiment, a spindle brake proper comprises shoe means 7 engageable with an inside periphery of a skirt 5 of wharve 4, and there is provided positioning means comprising an additional braking surface 9 which preferably extends over an angle from 15° to 30° and which is engageable by an additional brake shoe 12. Movement of a toggle device 14, 15 downwards to a substantially straight position applied the spindle brake proper to stop the spindle rotor, and also causes, through fluid operated means, inward movement of shoe 12. Further movement of the toggle device 14, 15 to a downwardly-angled position releases the spindle brake proper, and the spindle rotor is held in a required position when surface 9 is opposite the inwardly-moved shoe 12.

14 Claims, 9 Drawing Figures

APPARATUS FOR BRAKING AND POSITIONING A SPINNING OR TWISTING SPINDLE

BACKGROUND, OBJECTIVES AND BRIEF SUMMARY OF THE INVENTION

The invention relates to an apparatus for braking and positioning a spinning or twisting spindle with the spindle rotor in a specified position, including a spindle brake which is engageable with a rotary part of the spindle and positioning means separate from the brake.

On the basis of their principle of operation, spindle braking and positioning means can be divided substantially into two groups, the first group operating to position the spindle by using external drive means, while the other group employs energy from the spindle drive or the energy produced by braking the spindle for the operation of positioning the spindle.

The present invention relates to an arrangement belonging to the second group, the basic form of which may be substantially as described in German Patent Specifications Nos.: 16 85 934 and 16 85 942. In the arrangement described in German Patent Specification No.: 16 85 942, the spindle rotor, which is driven by a tangential drive belt, is initially brought to a halt by means of the spindle brake while the drive belt continues to act on the spindle rotor. The brake is then released and the rotor, as it slowly starts to move, can again be brought to a halt in an exactly defined preset position by a mechanical locking member which engages in notches or recesses. However, the shocks which occur when the locking member engages may be detrimental to the spindle and its bearings in the long term.

The essential object of braking and positioning means such as are used for example with a pneumatic thread-threading system, is to stop the spindle in a precise predetermined position, it being virtually essential, when mechanical latching or locking members or index pins which engage in recesses are used, that the spindle rotor should, in fact, have been fully braked beforehand so that the latching or locking member can engage in a recess in the spindle rotor or the shaft of the spindle cleanly or freely, and as far as possible without any shock.

Positioning means of this kind which operate essentially by means of inter-engagement are contrasted with braking and positioning means which operate by friction, such as are described, for example, in British Patent Specification No.: 1,357,465. This known arrangement includes a braking shoe for course braking which can be moved up to a braking surface, on a wharve of the spindle, from the outside. Opening at the brake shoe is a passage for compressed air through which compressed air can be fed to build up a cushion of compressed air between the braking surface on the wharve and the brake shoe. This cushion of compressed air forces the brake shoe slightly back from the braking surface on the wharve, with the result that the rotor of the spindle moves slowly round again under the drive torque acting on the spindle until the mouth of a passage arranged in the braking surface on the wharve is opposite the passage for compressed air opening at the brake shoe, when the cushion of compressed air is suddenly released and the brake shoe is re-applied to the braking surface on the wharve. This sudden release of the cushion of compressed air thus results in the spindle rotor being finely braked, or, in other words, exactly positioned, when the two air passages, in the brake shoe and the braking surface on the wharve, are aligned opposite one another.

In contrast to the known braking and positioning means which call for a relatively considerable amount of structural complication and which provide needlessly exact location of the spindle rotor in the preset position, the object of the invention is to enable there to be provided a more simply constructed and thus more reliable spindle braking and positioning means where it is permissible for the spindle to be stopped or locked within a certain angular range about a prescribed central position. It has, in fact, been found that for most purposes where it is necessary for the spindle to be positioned, an example being for the threading of thread through the spindle, it is enough for the spindle or the spindle rotor to be roughly positioned somewhere within a predetermined angular range. This is relevant both to manual and to pneumatic threading.

To achieve this object, there is provided an apparatus for braking and positioning a spinning or twisting spindle with the spindle rotor in a specific position, including a spindle brake engageable with a rotary part of the spindle and positioning means separate from said brake, wherein the positioning means comprises an additional braking surface extending over part of a periphery of a rotary part of the spindle, up to which an additional brake shoe or brake member can be moved. Preferably, the spindle brake is engageable with a wharve of the spindle and the periphery over part of which the additional braking surface extends is a periphery of said wharve. The spindle positioning means involved are means which operate by friction. This is of particular advantage because the spindle, which continues to be subject to the full propulsive torque from the spindle drive after the spindle brake which provides the spindle with its primary braking has been released, is not held and stopped or positioned abruptly but gently.

The additional braking surface, which may be arranged on the outer periphery of a wharve of the spindle in the form of a surface of a thickened portion projecting radially outwards, or on an inner periphery in the form of a surface of an indentation or re-entrant part projecting radially inwards, preferably extends for an angle of from 15° to 30°.

The spindle brake proper, i.e. the main device for braking the spindle or for absorbing its energy of rotation, and the positioning means, may have a common actuating mechanism. If, for example, the spindle brake proper, e.g. a brake in the form of an internal or external shoe-brake, and the brake shoe or brake member of positioning means consisting of an additional braking surface and an additional brake shoe or brake member which can be moved up to it, both are engageable in common either with an inner periphery or outer periphery of a wharve of the spindle, preferably they are situated on the wharve braking surfaces at different levels whereby the two brakes do not interfere with each other's operation.

A common actuating mechanism for the spindle brake proper (for coarse braking) and for the additional brake (for fine braking) preferably comprises a toggle lever device which can assume three specified positions and which acts directly on the spindle brake proper and indirectly on the additional brake or brake shoe or brake member through a piston and cylinder means. The three specified positions of the toggle lever device (articulated lever device) in this case can be associated with different braked states, with the added aim of giving an operator the widest possible facilities for control.

DETAILED DESCRIPTION OF PREFERRED EMBODIMENT OF THE INVENTION

Figure 1:
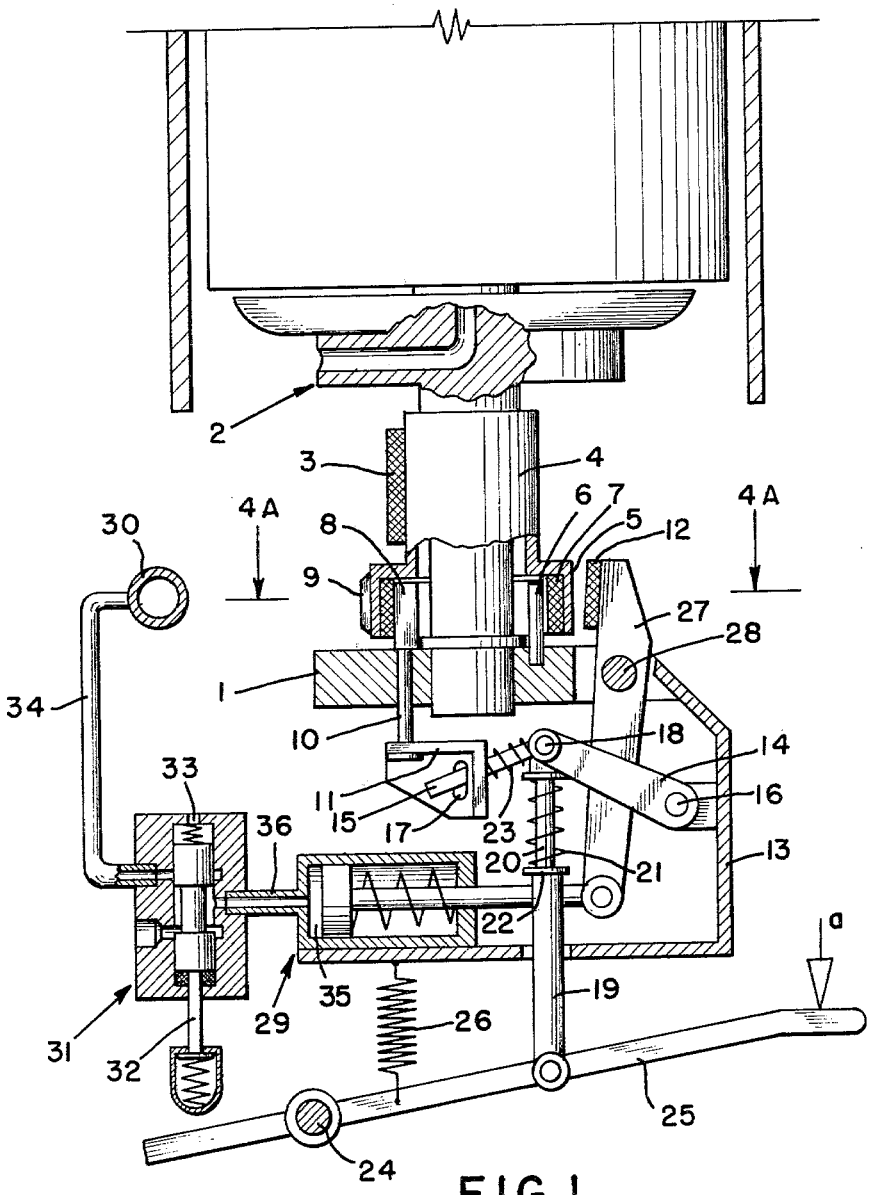
FIGS. 1 to 3 are diagrammatic sectional views illustrating a spinning or twisting spindle having an associated braking and positioning arrangement constructed in accordance with the invention shown in different positions.

Referring to FIGS. 1 to 4C of the drawings, a longitudinally-extending member 1 of a machine is used to carry a spinning or twisting spindle which is indicated by the reference character 2, and the rotor of which may, for example, as shown here, be driven by a tangential drive belt 3 which engages with a spindle shank which is formed as a wharve 4. Formed at the lower end of the wharve 4 is a skirt-like projection 5 which has associated with it an internal brake somewhat like that described in German Patent Specification No. 16 85 934. This internal brake comprises two brake shoes 7 which are mounted to pivot about a pivot pin 6, between the free ends of which an expander spigot 8 is inserted parallel to the axis of the spindle. Rigidly secured to the lower end of the spigot 8 is a braking lever 11 (see also FIGS. 4A to 4C). On the outer periphery of the projection 5 from the wharve 4 is an additional braking surface 9 in the form of a thickened surface which projects outwards radially and which preferably extends over an angle of from 15° to 30°.

Figure 4A:
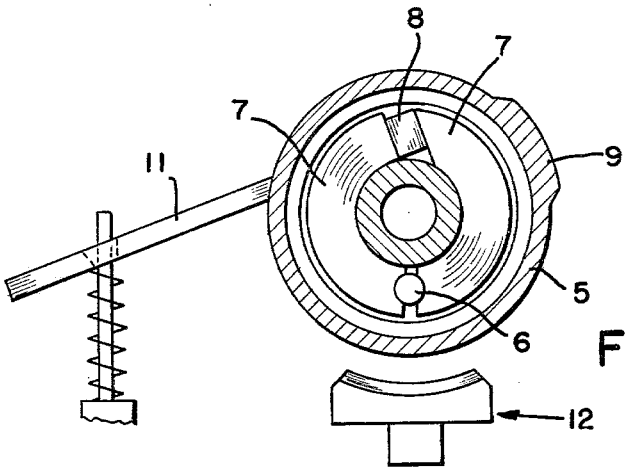
FIGS. 4A to 4C are simplified, diagrammatic sectional views on, respectively, lines 4A, 4B and 4C in FIGS. 1, 2 and 3.

FIGS. 1 and 4A show the spindle brake proper, which comprises the brake shoes 7, in its released position, i.e. the position where it is withdrawn from the inside periphery of the wharve, in which position the wharve 4 and thus the rotor can be rotated by the tangential drive belt 3.

The expander spigot 8 which is used to operate the internal brake 7—7 is secured to the braking lever 11 by means of a shaft 10 rotatably mounted in the longitudinally-extending member 1 of the machine. If the brake lever 11 is swivelled from the rest position shown in FIG. 4A to the braking position shown in FIG. 4B, the expander spigot 8 is moved in such a way that it pivots the two brake shoes 7—7 outwards about the pivot pin 6 so that they come to bear against the inner periphery of the skirt-like projection 5 on the wharve 4. Braking takes place while the tangential drive belt 3 continues to slip on the outside of the wharve 4.

It will be seen that this braking by the internal brake 7—7 causes the wharve with the rotor of the spindle to stop at a random angle without being specifically positioned.

Figure 4B:
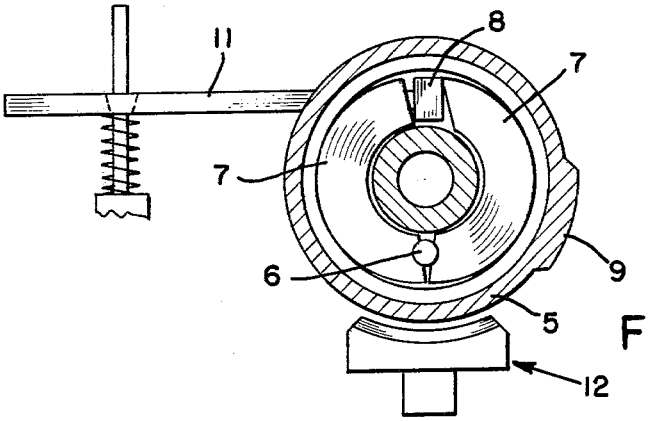
Figure 4C:
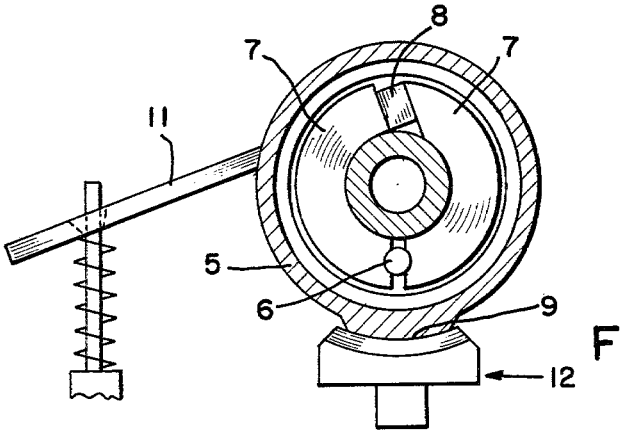

To position the rotor or wharve of the spindle as required, use is made of the additional braking surface 9 in conjunction with an additional brake shoe 12, the operation of which will be hereinafter described with reference to FIGS. 4A to 4C.

Once the spindle rotor or the spindle wharve 4 has been braked or brought to a halt by actuating the internal brake 7—7, the additional brake shoe 12 is moved from a position in which it is spaced from the wharve 4 (FIGS. 1 and 4A) towards the spindle axis for a distance such that braking contact is possible between the said additional brake shoe 12 and the additional braking surface 9. The internal brake 7—7 is then released by swivelling the braking lever 11 back to its original position (FIGS. 4A and 4C), with the result that the spindle rotor or the spindle wharve 4 is turned again by its tangential drive belt 3 until the additional braking surface 9 comes opposite the additional brake shoe 12, as a result of which the rotor is braked by friction and is held at an "approximately" preselected positioned setting. FIG. 4C shows an exactly positioned setting where the vertical center lines of the additional brake shoe 12 are substantially in line with one another. It is possible in this case, and indeed permissible, for the center lines of the braking surface 9 and the additional brake shoe 12 not to be directly opposite one another when the braking of the spindle wharve 4 is complete, the position within the permitted range which is finally reached depending on the drive torque applied by the spindle drive and the random point in time at which the additional braking surface 9 and the additional braking shoe 12 come into action.

Figure 2:
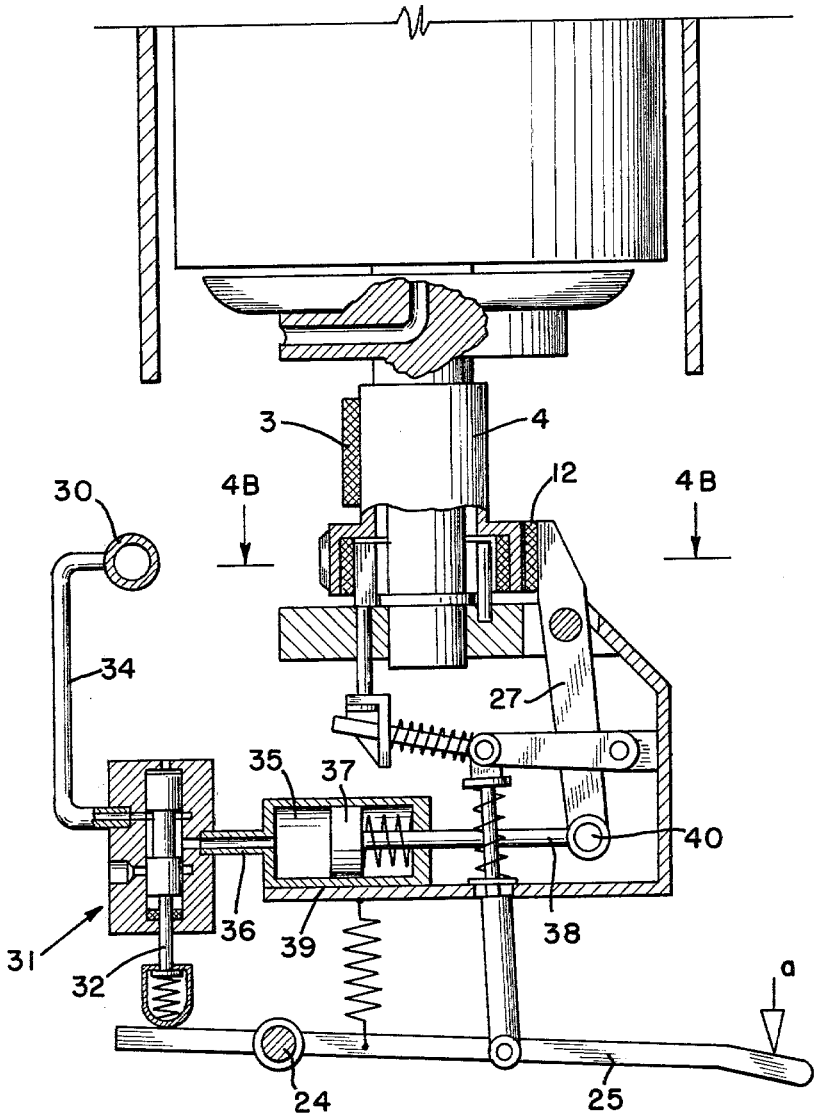
Figure 3:
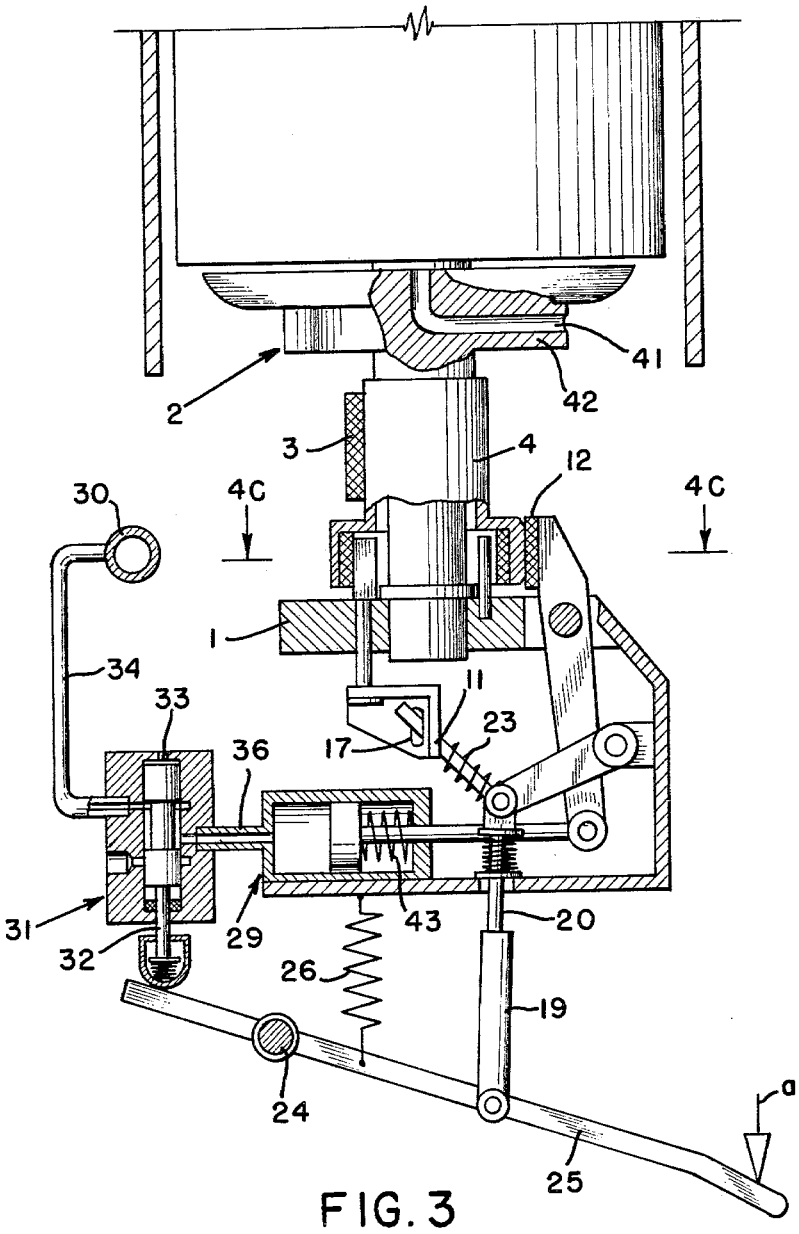

FIGS. 1 to 3 show the common actuating mechanism for the spindle brake proper (the internal brake 7—7) and the additional brake shoe 12, in their various operating positions during the braking and positioning of the spindle rotor or the wharve 4.

Secured to the longitudinally-extending member 1 of the machine is a mounting 13 to which a toggle lever mechanism or device comprising two single-armed levers 14 and 15 is articulated by means of a pivot shaft 16. The braking lever 11 is provided with an aperture 17 for the articulation of the free end of the single-armed lever 15. The elongated aperture 17 is so formed that it is possible for the braking lever 11 to pivot from the rest position (FIGS. 1 and 4A) to the braking position (FIGS. 2 and 4B) without skewing the single-armed lever 15. Engaging with the central articulation 18 of the toggle lever mechanism or device 14, 15 is a push rod which has a thicker section of shank 19 and a section of shank 20 of smaller diameter than the latter. Mounted on the section of shank 20 is a return spring 21 the bottom end of which bears against or is fastened to an abutment or washer 22 loosely mounted on section of shank 20, which abutment, in the rest position shown in FIG. 1, bears against the top edge section of shank 19, as a result of which the spring 21 exerts a specific upwardly directly force on the articulation 18.

Slid over the single-armed lever 15 of the toggle lever device 14, 15 is a compression spring 23 which bears, on the one hand, against the articulation 18 and, on the other hand, against the braking lever 11.

The push rod 19, 20 is, at the bottom end of its shank, articulated to an operating lever 25 which can be pivoted about a shaft 24. A tension spring 26, of which one end is fastened to the mounting 13, engages with the operating lever 25.

To actuate the internal brake 7—7, the operating lever 25 is pivoted downwards or clockwise about shaft 24 in the direction of arrow a, as a result of which the push rod 19, 20 is drawn vertically downwards. As a result, a force directed substantially at right angles to the line connecting the two outer articulations is exerted on the center articulation 18, whereby the toggle lever mechanism or device is moved, in a first part of its movement, from its uppermost angled position to the substantially straight position shown in FIG. 2. The straightening of the toggle lever mechanism or device exerts, through the compression spring 23, a shifting force on the braking lever 11 as a result of which the braking lever 11, and thus the expander spigot 8, are turned, whereby the internal brake 7—7 comes into action as shown in FIG. 4B and brakes the spindle rotor or the spindle wharve 4.

When the toggle lever mechanism or device is in the straightened position, the return spring 21, inserted over the shank section 20, comes to bear against the mounting 13 through the abutment member 22 (see FIG. 2), as a result of which a holding point or point of resistance can be felt through the operating lever 25. In this way the operator is signified that the toggle lever device is in its straightened position in which the internal brake 7—7 exerts its full effect.

When the operating lever 25 is turned from the position shown in FIG. 1 to the position shown in FIG. 2, at the same time the additional brake shoe 12 (which is secured to a two-armed lever 27 which can be pivoted about a shaft 28) is moved from the position shown in FIGS. 1 and 4A in which it is spaced from the wharve 4 to the position closer to the axis of the spindle rotor which has already been described above in connection with FIG. 4B, the additional brake shoe 12 being moved by means of a piston and cylinder unit 29 and a control valve 31 which can be actuated by the operating lever 25 that is connected to a source 30 of a pressurized fluid such as of compressed air.

The arrangement of the control valve 31, which is provided with an actuating member 32 on which a return spring 33 acts, is such that when in the rest condition shown in FIG. 1, on the one hand, it blocks the compressed air line 34 leading to the source 30 of compressed air or pressurized fluid, and, on the other hand, connects the pressure chamber 35 of the piston and cylinder unit 29 to free air. When the operating lever 25 has been turned downwards to the position shown in FIG. 2 to straighten the toggle lever device 14, 15, the control valve 31 is adjusted through the actuating member 32 in such a way that the pressure chamber 35 is connected through connecting line 36 to the compressed air line 34 leading to the source 30 of compressed air. As a result of this condition, piston 37 and piston rod 38 are displaced in the cylinder 39, whereby the double-armed lever 27, which is articulated to the piston rod 38 at an articulation point 40, is turned so that the additional brake shoe 12 is moved towards the axis of the spindle about the shaft 28.

When the operating lever 25 is depressed further downwardly to the position shown in FIG. 3, the toggle lever mechanism 14, 15 is moved from the straightened position to a lowermost angled position by the push rod 19, 20 which engages with the center articulation 18. As a result the compression spring 23 which operates between the center articulation 18 and the braking lever 11 is relaxed again, with the result that the braking lever 11 is turned back to its original position under the prompting of a return means (not shown) inside the spindle brake (see FIGS. 3 and 4C). As a result of this return pivoting movement by the braking lever 11, the expander spigot 8 also is returned to its original position, thereby releasing the internal brake 7—7. Upon release of the internal brake 7—7, the spindle rotor or the spindle wharve 4, is set rotating again by the tangential drive belt 3 until the additional braking surface 9 reaches the area occupied by the additional brake shoe 12, whereby the wharve 4, and thus the spindle rotor, is braked again. This final braked and positioned setting of the rotor is evident firstly from FIG. 4C and secondly from the physical position for a thread passage 41 in a thread storage disc 42 (see random position for the passage 41 in the thread storage disc shown in FIG. 2 relative to the required threading position shown in FIG. 3).

The spindle is now situated, as shown in FIG. 3, in a position suitable for further operations in which for example a thread can be threaded through the spindle automatically and so on.

After the requisite servicing work has been carried out, the operating lever 25 is released again, so that the individual components of the actuating mechanism may return to their original positions as shown in FIG. 1 under the prompting of the return springs hereinbefore described, and of a return spring 43 for the piston 37.

The return spring 21 may be largely free of stress during the first part of the movement of the toggle lever device 14, 15 but spring 21 comes under substantially more stress when the toggle lever device 14, 15 reaches the straightened position, and becomes fully stressed when the toggle lever device 14, 15 moves further onward past the straightened position during the second part of its movement.

Figure 5C:
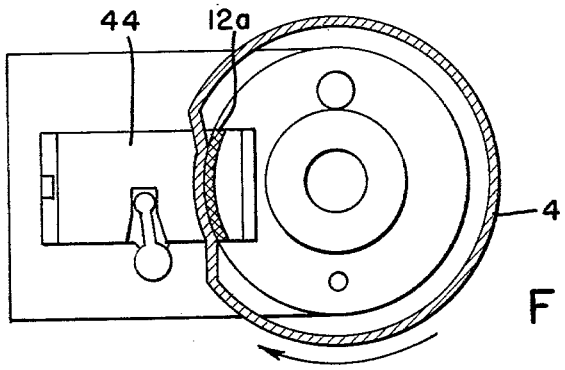
FIGS. 5A to 5C are simplified, diagrammatic sectional views of a modified embodiement of an additional brake associated with a spindle shaft which acts on an inner periphery of a spindle wharve.
Figure 5B:
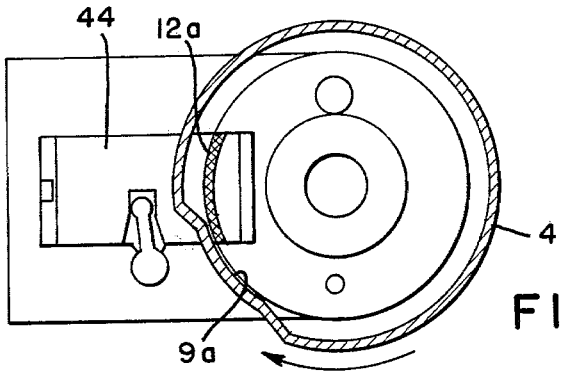
Figure 5A:
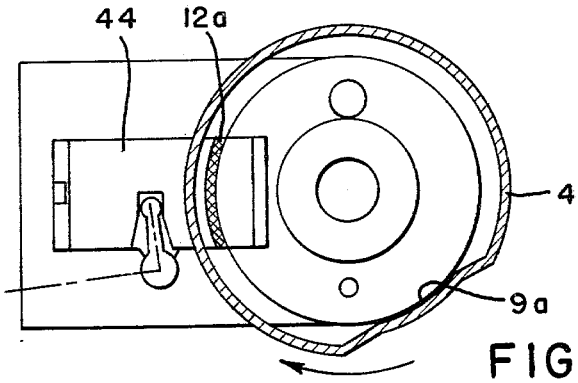

In the embodiment of the invention shown in FIGS. 5A, 5B, and 5C, the positioning means for the spindle are transferred inwards from the outer periphery of the wharve 4. In this embodiment, the additional braking surface **9*a* is arranged, on an inner periphery of the wharve 4, in the form of a surface of an indentation projecting radially inwards, and is co-operable with a brake shoe 12*a* mounted on a slider 44 which is able to move underneath the wharve 4**.

What is claimed is:

1. An apparatus for braking and positioning a spindle rotor of a spinning or twisting spindle in a specific position comprising; a spindle having a rotary section, a spindle brake engageable with said spindle rotary section, spindle positioning means separate from said spindle brake, said rotary section of said spindle having a periphery, said positioning means including an additional braking surface extending over said periphery, an additional movable brake shoe, and means for urging braking engagement between said movable brake shoe and said additional braking surface.

2. An apparatus as claimed in claim 1, a wharve on said spindle engageable with said spindle brake, said wharve having a periphery for engaging with said additional braking surface.

3. An apparatus as claimed in claim 2, said spindle wharve having a skirt for said additional braking surface, and said additional braking surface on said skirt extending for an angle of from 50° to 30°.

4. An apparatus as claimed in claim 3, said additional braking surface being mounted on said wharve periphery and projects outwardly radially forming a surface of thickened area.

5. An apparatus as claimed in claim 1, a wharve on said spindle engageable with said spindle brake, said wharve having an inner periphery supporting said additional braking surface, said inner periphery forming said additional braking surface having a radially inwardly extending indentation.

6. An apparatus as claimed in claim 1, a common actuating mechanism for moving said spindle brake, and said additional brake shoe to said additional braking surface.

7. An apparatus as claimed in claim 6, said common actuating mechanism comprising a toggle lever means, a cylinder, and a a movable piston in said cylinder connected to said toggle lever means whereby said toggle lever means acts directly on said spindle brake through said movable piston in said cylinder and indirectly on said additional brake shoe.

8. An apparatus as claimed in claim 1, a toggle lever means having a pair of pivotally connected toggle levers, one of said levers having a pivoted fixed end and another end pivotally connected to said other lever of said pair, said other lever having a free end, a pivotable braking lever co-operatively receiving said lever free end, a shaft having a first and a second end, a spigot mounted on said first shaft end and said pivotable breaking lever mounted on said second shaft end, said spigot being positioned to actuate said spindle break, an operating lever pivotally mounted intermediate its length in spaced relation to said toggle levers, and a push rod connected at one end to said operating lever and the other end to said toggle levers at the pivotal connection of said pair of levers whereby the vertical displacement of said operating lever actuates said toggle lever means to displace said pivotable braking lever and said spigot.

9. An apparatus as claimed in claim 8, said braking lever for said spindle brake having an aperture for co-operatively receiving and retaining said free end of said other lever of said toggle lever means, and resilient spring means mounted on said braking lever between said braking lever and said pivotal connection of said pair of toggle levers.

10. An apparatus as claimed in claim 9, said push rod having resilient means mounted thereon whereby in a brake release first position said push rod is elevated with said operating lever, and in a toggle means actuated intermediate position the push rod is depressed vertically with said operating lever, and in a toggle lever means fully displaced position upon full depression of said push rod and operating lever.

11. An apparatus as claimed in claim 7, an operating lever pivotally mounted intermediate its length connected to said toggle lever means.

12. An apparatus as claimed in claim 11, control valve means for supplying fluid under pressure to said cylinder and piston for displacing said operating lever whereby said additional brake shoe is actuated.

13. An apparatus as claimed in claim 11, an additional brake shoe lever pivotally mounted intermediate its length, said additional brake shoe lever having an end supporting said additional brake shoe and a piston rod connected pivotable end, said pivotable end being connected to said movable piston slidable in said cylinder.

14. An apparatus as claimed in claim 12, said operating lever having a control valve means on in spaced relation to said operating lever pivot, and a push rod arm in spaced relation to said operating lever pivot and said control valve means arm.

* * * * *

UNITED STATES PATENT AND TRADEMARK OFFICE

CERTIFICATE OF CORRECTION

PATENT NO. : 4,326,372

DATED : April 27, 1982

INVENTOR(S) : Siegfried Inger

It is certified that error appears in the above-identified patent and that said Letters Patent is hereby corrected as shown below:

Column 6, line 58, Claim 3, line 4, "50°" should read -- 15° --.

Signed and Sealed this

First Day of March 1983

[SEAL]

*Attest:*

GERALD J. MOSSINGHOFF

*Attesting Officer*

*Commissioner of Patents and Trademarks*